US006296703B1

(12) United States Patent
Becker

(10) Patent No.: US 6,296,703 B1
(45) Date of Patent: Oct. 2, 2001

(54) PNEUMATIC ACTUATOR, ESPECIALLY FOR CONTROLLING A BASIS WEIGHT PROFILE OF A WEB ACTUATOR

(75) Inventor: Ingo Becker, Köln (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/205,497

(22) Filed: Dec. 4, 1998

(30) Foreign Application Priority Data

Dec. 5, 1997 (DE) ..... 197 53 899

(51) Int. Cl.[7] ..... B05C 3/02

(52) U.S. Cl. ..... 118/410; 118/419; 118/325; 118/123; 254/93 HP

(58) Field of Search ..... 254/93 HP, 93 R; 118/413, 261, 410, 120, 123, 325, 419; 239/451, 455

(56) References Cited

U.S. PATENT DOCUMENTS 3,800,569 4/1974 Wilcox .
4,665,859 5/1987 Dunlap .

FOREIGN PATENT DOCUMENTS 32 20 075 12/1983 (DE) .
38 34 719 4/1990 (DE) .
43 34 556 4/1995 (DE) .
44 33 048 3/1996 (DE) .
295 20 686 U 5/1996 (DE) .
296 10 773 U 10/1996 (DE) .
195 32 920 3/1997 (DE) .
195 38 861 4/1997 (DE) .
196 17 458 6/1997 (DE) .
296 22 365 U 7/1997 (DE) .

*Primary Examiner*—Brenda A. Lamb
(74) *Attorney, Agent, or Firm*—Herbert Dubno

(57) ABSTRACT

A pneumatic actuator for control of the coating thickness or basis weight of a coating apparatus for paper or cardboard webs has a pair of spring metal plates which can be deflected outwardly by a pneumatically extendable cushion between these plates in a frame. One end of the pair of plates is anchored while the other end is attached to a coating pin which works against a compression spring counteracting the outward deflection of the metal plates.

8 Claims, 6 Drawing Sheets

PNEUMATIC ACTUATOR, ESPECIALLY FOR CONTROLLING A BASIS WEIGHT PROFILE OF A WEB ACTUATOR

FIELD OF THE INVENTION

My present invention relates to a pneumatic actuator, especially for controlling the transverse profile of a coating device in an apparatus for coating of paper or cardboard webs having elements spaced across the width of the web and which can be adjusted to regulate that transverse profile or coating cross section.

BACKGROUND OF THE INVENTION

For the coating of paper or cardboard webs with viscous coating materials or coating materials which are applied by doctoring or jet coating, especially pigmented materials, sizings and the like, it is important to provide the coating apparatus with the ability to control the cross section of the coating applied, i.e. the transverse profile, both in terms of the basis weight (weight per unit area of the coating) or the thickness thereof. For that purpose a row of adjusting elements may be provided across the width of the web which can control the local basis weight or thickness so that the result of effective positioning of these elements individually is control of the transverse profile. Usually the goal is to eliminate variations in the transverse profile which may result in the production of the coated web and the goal is to insure a uniform coating.

In the coating of paper or cardboard webs, so-called doctor blade apparatuses may be provided in which an excess of the coating material, for example a coloring matter, in a viscous form is applied and the excess is doctored off by an elastic doctoring blade which can also be referred to as a shaving or scraping blade and which removes that excess, leaving a uniform coating. The level of the basis weight of the coating remaining on the web can be adjusted by locally varying the pressing force of the blade against the coating on the web. The blade can thus be backed by a bendable bar upon which the setting elements act.

Such a doctor blade arrangement is described in WO 93/17795 and here the flexible bar is provided with a row of setting elements for adjusting locally varying pressing forces. Each setting element comprises an axially-shiftable rod or pin guided in a holder and positionable by a set screw against the force of a compression spring. The compression spring, the screw and the rod act axially.

In DE-OS 44 32 177, a so-called free jet nozzle applicator is disclosed which utilizes a slit nozzle formed between two lips from which a free jet of the coating material is directed against the web or an applicator roller which applies film of coating material formed on that roller to the web. To adjust a certain transverse profile of the coating of the two lips of the slit nozzle may be yieldable and can be adjusted differently in different zones over its length relative to the other lip. The adjusting elements are adjusting screws spaced apart across the width of the web, prestressed by spring elements. The actuation of the adjusting screws is effected either manually or by means of servomotors or the like.

OBJECTS OF THE INVENTION

It is the principal object of the present invention to provide n improved actuator for a setting element utilizable in a coating apparatus whereby drawbacks of earlier systems are avoided.

Another object of the invention is to provide a system for controlling the transverse profile of a coating, in a coating apparatus, which utilizes structurally simple, reliable and accurately controllable actuators and wherein the actuators have highly reproducible effects with minimum hysteresis.

It is also an object of the invention to provide an improved actuator for use in a coating profile controlled arrangement of the latter type.

SUMMARY OF THE INVENTION

These objects and others which will become apparent hereinafter are attained, in accordance with the invention in a pneumatically-operated actuator which can comprise:

- a frame;
- a pair of generally parallel, mutually spaced apart sheet-metal spring plates in the frame and secured to the frame at one side of the plates;
- a pin longitudinally shiftable in the frame and secured to an opposite side of the pair of plates;
- a pneumatic cushion formed between the plates and connectable to a source of compressed air whereby pressurization of the cushion deflects the plates transversely, thereby longitudinally shifting the pin; and
- a spring on the frame yieldably counteracting transverse deflection of the plates.

Preferably the pin is guided through a seat for the spring which, advantageously is a coil compression spring braced between these seats and a plate on the pin so that the spring biases the pin axially outwardly with respect to the frame.

To minimize friction between the cushion and the spring plates, a low friction foil may be interposed between the cushion and each plate.

The displacement of the pin can be measured by a displacement-measuring device which directly monitors the axial stroke of the pin or by a measuring device which is a response to deflection of one of the plates The actuator is preferably used as one of a multiplicity of such actuators in an apparatus for coating a web, especially of paper or cardboard, which has a corresponding number of control elements disposed across the path of the web and positionable to vary the basis weight or profile of the coating applied to the web. The device may include a doctor blade which removes excess material from the coating and which is backed by a bendable member upon which the control elements act, the control elements being spaced apart along this bendable member. The bendable member in turn, acts upon the doctor blade. Alternatively, the control element can act upon a flexible lip of a slit nozzle of the type described.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
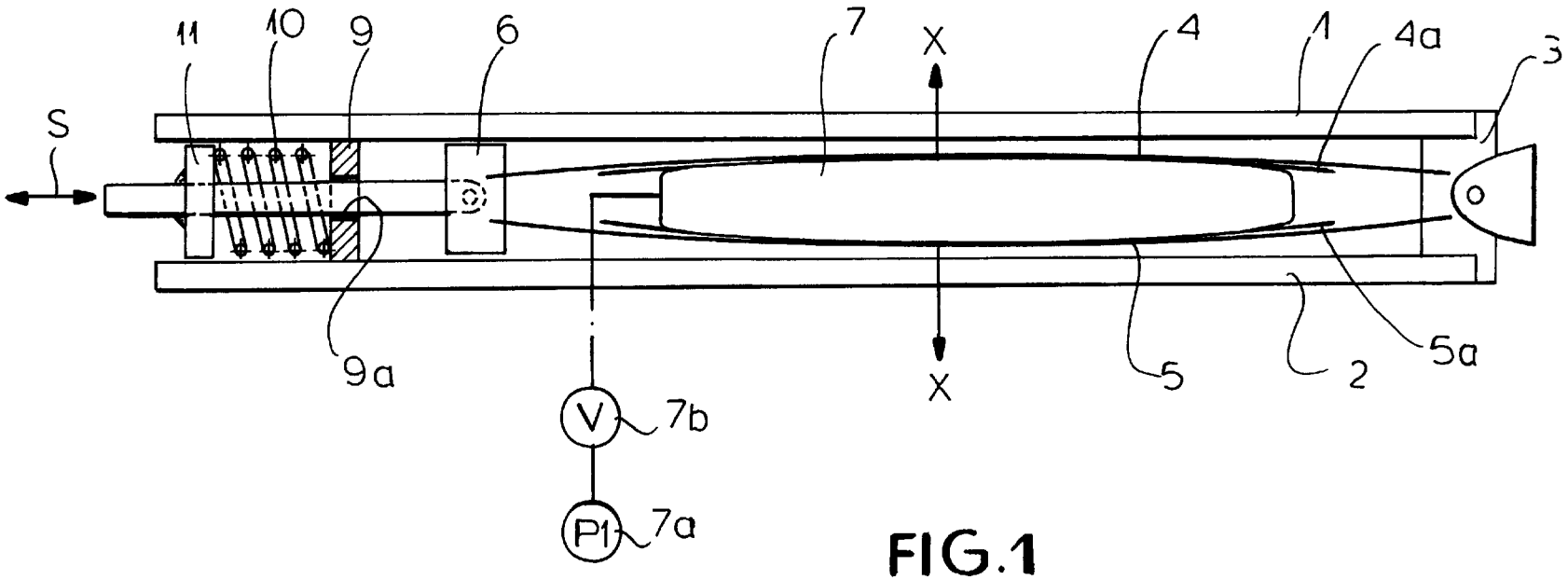
FIG. 1 is a diagram of a pneumatic actuator according to the invention as seen from the side.
Figure 2:
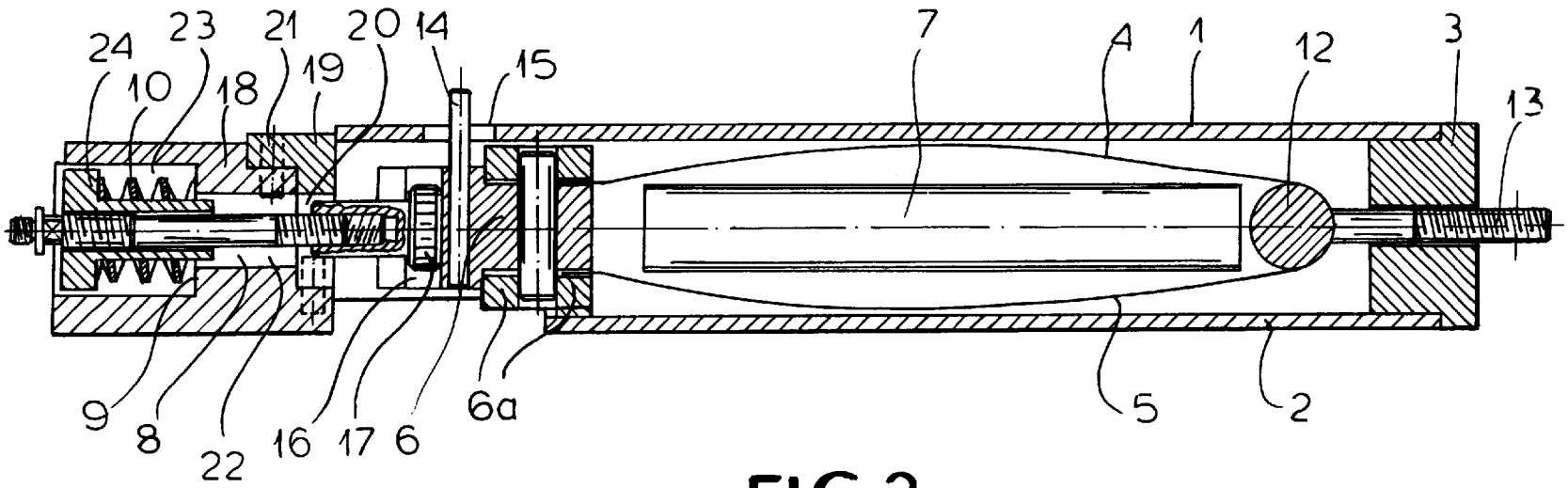
FIG. 2 is a longitudinal section of a concrete embodiment of such an actuator.

FIG. 1 is a schematic illustration of a pneumatic actuator according to the invention and comprises a rigid frame with two spaced-apart plates, namely, an upper plate 1 and a lower plate 2 which are interconnected at the right hand end as shown in FIG. 1 by an end plate 3. Between the two rigid plates 1 and 2, there is provided a pair of mutually-spaced and generally parallel spring sheet-metal members 4, 5 which have broad surfaces turned toward one another. The spring plates 4 and 5 are fixed together at one of their longitudinal ends by the end plate 3. At their other longitudinal end the pair of plates 4, 5 are affixed to a block 6 which is slidable between the rigid plates 1, 2 in the longitudinal dimension of the spring plates 4, 5.

Between the spring plates 4, 5, a bladder 7 forming a pneumatic cushion, is provided, the bladder being connected as shown diagrammatically in FIG. 1, to a source 7*a* of compressed air, e.g. via a control valve 7*b* which regulates the degree of pressurization of the bladder 7.

As the bladder or cushion 7 is pumped up, the spring plates 4, 5 are deflected outwardly to reduce the effective length of the spring plate pair so that the left hand end of the pair of spring plates and the block 6 are drawn toward the end plate 3, i.e. to the right in FIG. 1. At the side of the block 6 turned away the spring plates 4, 5, a pin 8 is centrally affixed and thus extends in the longitudinal dimension of the spring plates 4, 5. The pin 8 is axially shiftable in an opening 9*a* in a seat 9 which is affixed between the plates 1, 2 and serves as an abutment for a coil compression spring 10 braced between the seat 9 and a shoulder 11 on the pin 8.

The compression spring 10 thus acts to counter the transverse deflection of the plates 4, 5 in the direction of the arrows x and thus is compressed upon a shortening of the effective length of the spring plate pair 4, 5. The spring 10 draws the spring plates 4, 5 planar when the cushion 7 is decompressed.

The spring plates 4, 5 are so mounted in the frame that their transverse bending suffices for the desirable strokes of the pin 8. For that purpose, there must be sufficient free space in the frame or the spring plates 4, 5 must be spaced part by sufficiently large distances from the plates 1, 2. When compressed air is admitted to the cushion 7, the spring plates 4, 5 are urged apart to foreshorten the effective length of the pair of spring plates, displace the block 6 and the pin 8 to the right and increase the compression of the spring 10. The transverse forces on the spring plates 4, 5 are balanced so that there is minimum friction of the pin 8 in the guide 9. Since the spring 10 counters the transverse deflection of the spring plates 4, 5, the adjustment of the pin 8 is accomplished without play and thus the hysteresis is minimal so that the positioning of the pin 8 and any setting element actuated thereby is highly reproducible.

Any axial forces applied from the exterior to the pin 8 are taken up by the spring 10 and absorbed by the seat 9. There is no compression force applied to the spring plates 4 and 5 in their longitudinal direction. This prevents the spring plates 4, 5 from buckling inwardly or outwardly. At the same time there is a well-defined relationship between the outward deflection x of the spring plates 4 and 5 and the axial stroke s of the pin 8. This enables indirect measurement of the stroke by a measurement of the transverse deflection of one of the plates 4, 5 as has been shown in FIG. 3. Such an indirect measurement of the stroke s is advantageous when no direct measurement in the region of the pin 8 is possible because there is insufficient space around the pin 8 to provide the measuring device. Comparatively large and inexpensive measuring units can be provided in the region of the spring plate 4 if desired.

To minimize friction between the cushion 7 and the spring plates 4, 5, low friction foils 4*a* and 5*a* can be provided between the spring plates 4, 5 and the cushion 7. These foils can be cemented on the inner surfaces of the spring plates 4, 5 if desired. Suitable low friction foils can be composed of polytetrafluoroethylene.

FIGS. 2–6 show concrete embodiments of the actuator and its use in controlling coating via a doctor blade or a nozzle lip in respective zones thereof.

Since it may be desirable to replace the force-generating parts of the actuator upon the discernment of defects, for example the bursting of the compressed air bladder, these force-generating parts can be made separate from the parts carrying the compression spring 10 and its seat 9 and can be attached to these parts by bolting or screw connections.

The frame of the force-generating part can be comprised of the cover plate 1, the bottom plate 2, the end plate 3 and two further side plates 25, 26 which are perpendicular to the plates 1, 2 and the end plate 3 and laterally close the frame.

The spring plates 4 and 5 are fixed at their rear ends rigidly with the end plate 3, i.e. are fixedly clamped thereto as has been shown in the drawing and, to this end they are anchored to the pin 12 which has a screw 13 threaded into the end plate 3.

If the spring plates 4, 5 are sufficiently bendable, they can be fabricated in a single piece and this single piece can be looped around the pin 12. At the opposite end, the spring plates 4, 5 are clamped in the block 6 which can provide the holder affixed to the pin 8. The block 6 in this embodiment can be movable between plates 1, 2. The bladder forming the compressed air cushion 7 is shown here diagrammatically to lie between the deflected plates 4 and 5.

On the block 6, between the pin 8 and the clamp 6*a* securing the plates 4, 5 thereto, a measurement pin 14 is affixed and extends perpendicular to the direction of displacement of the pin 8 through an elongated window 15 in the cover plate 1. The pin 14 allows the movement of the block 6 and hence of the pin 8 to be followed and can cooperate with a detector for providing a signal representing the stroke of the pin 8 and hence the setting thereof.

The pin 8 can be connected to the block 6 by a plug connector. For this purpose, the block 6 can have at its front end a T groove 16 which receives a bead 17 threaded onto an end of the pin 8. The pin 8 can extend into a housing 18 which is axially aligned with the shank of the T groove 16 and is connected by a screw-thread arrangement to the side plates of the frame. At the front end of the cover plate 1, an angled fastening plate 19 is welded and is formed with a central downwardly opening passage 20 through which the pin 8 is guided. The frame with the force-generating parts is connected by screws 21 to the housing 18, the screws 21 traversing the fastening plate 19. Upon removal of the fastening screws 21, the force-generating parts can be removed from the housing 18. The housing part 18 with the pin 8 and the bead 17 can be slipped out of the T groove 16 upon lifting of the frame. The bottom plate 2, so that it should not interfere with this movement, ends in the region of the block 6. Between the bottom plate 2 and the housing 18 there is thus sufficient free plates to enable the end of the pin 8 with the bead 16 to be moved therethrough.

The housing 18 includes a passage 22 through which the pin 8 is guided and which opens via the broad blind bore 23 outwardly. The inner wall of the blind bore 30 forms the seat 9 for a compression spring 10 received in the blind bore 23 around the pin 8. The outer end of the compression spring 10 presses against a shoulder 24 attached by a screw-thread arrangement to the pin 8. The outer dimensions of the shoulder 24 are so matched to the blind bore 23 that an axial movement of the pin 8 is not restricted.

The actual embodiment of the device used in practice has the advantage that the housing 18 with the elements contained therein can be fixed on the machine parts of the coating unit permanently. In case of a defect in the force-generating part with the compressed air cushion 7, this part can be readily removed at low cost and replaced. The housing 18 with the pin 8 can be used for manual displacement without the force-generating part, in which case an adjustment nut can be threaded onto the end of the pin 8.

Figure 3:
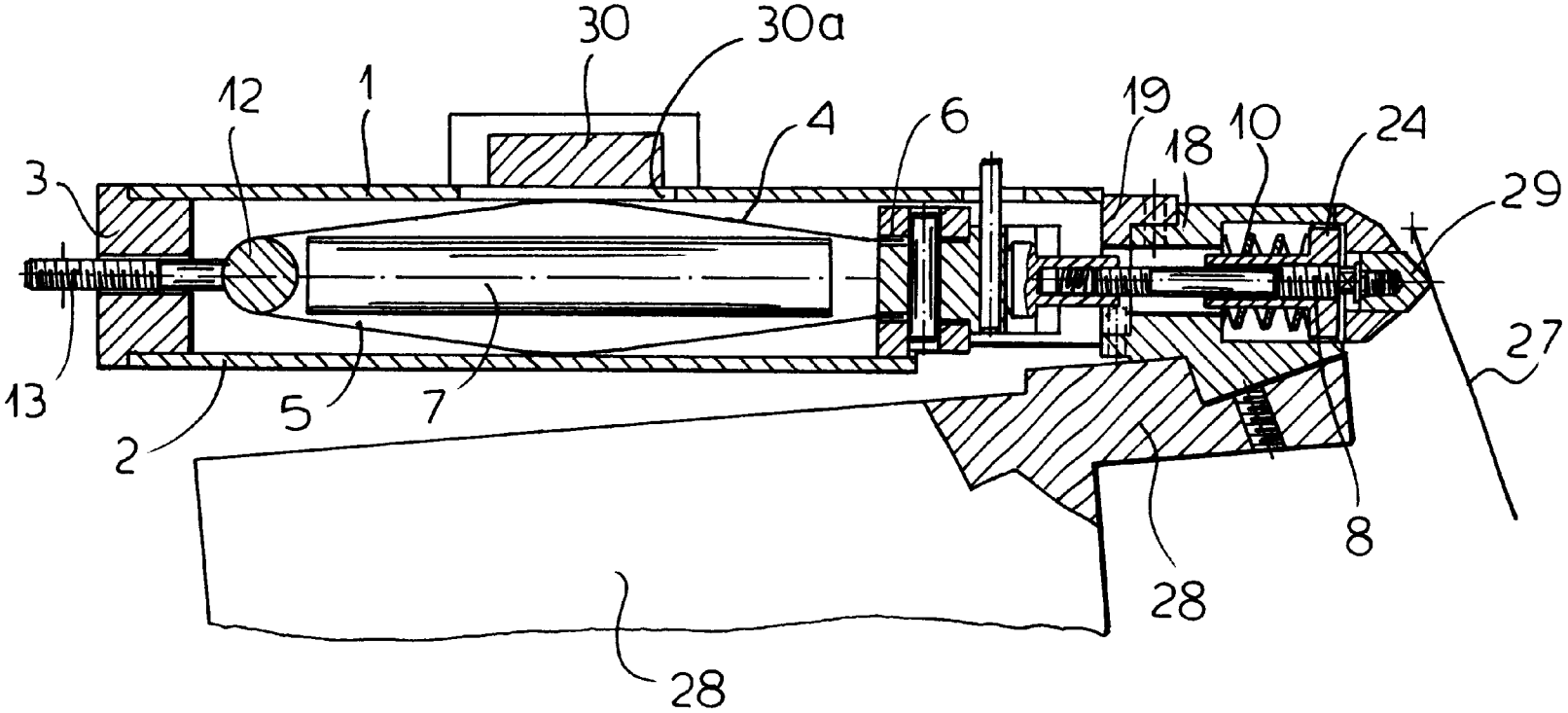
FIG. 3 is a longitudinal section through an actuator forming part of an apparatus in which a doctor blade removes excess coating material.
Figure 4:
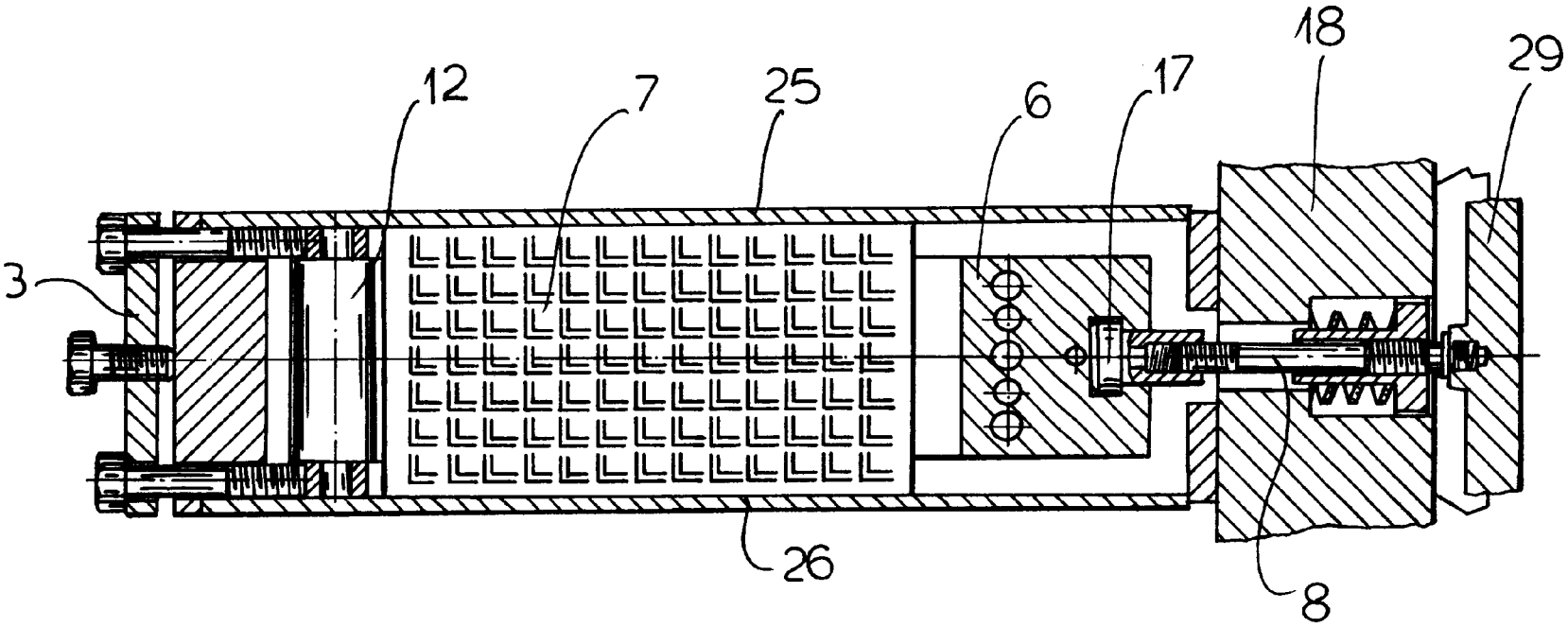
FIG. 4 is a section through the actuator of FIG. 3 taken in an axial plane perpendicular to the axial plane of the section of FIG. 3.
Figure 5:
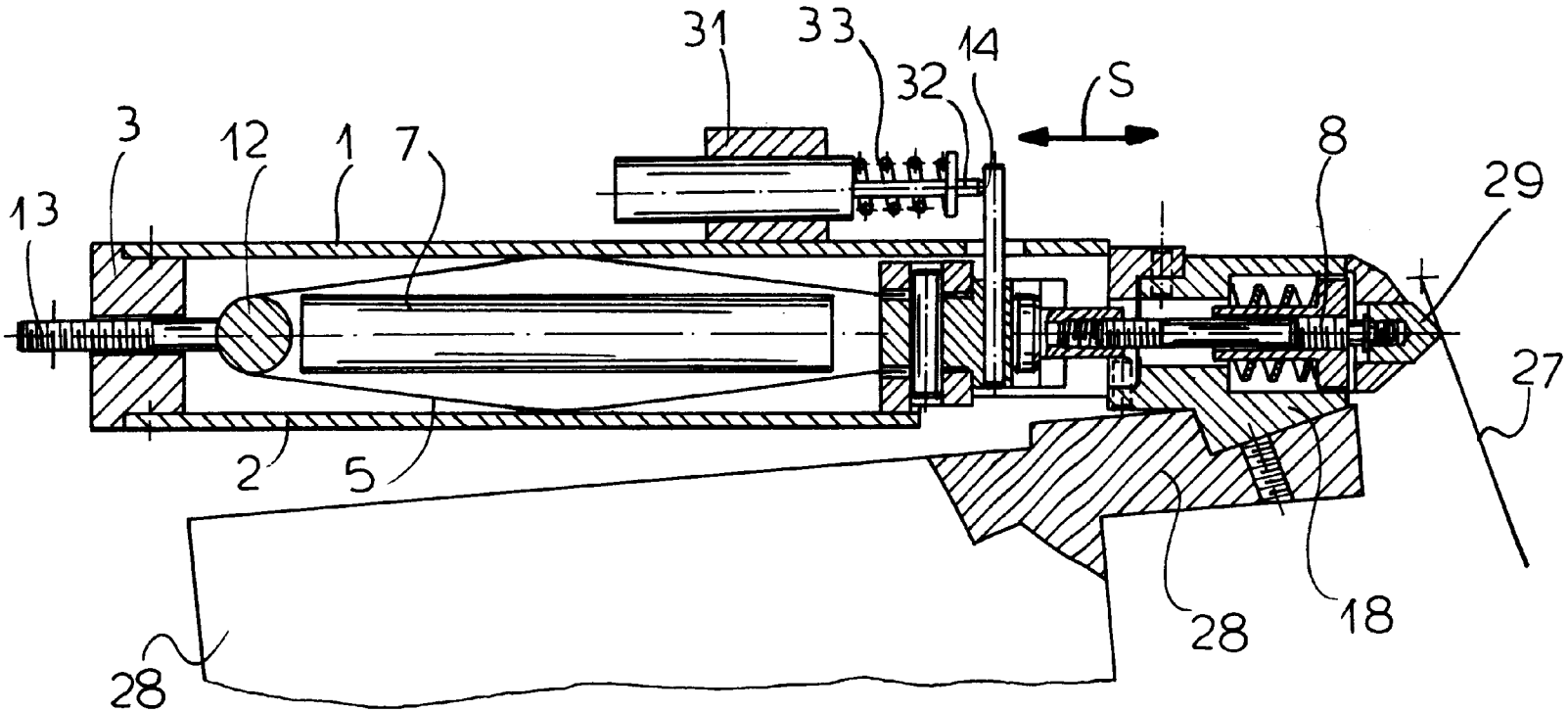
FIG. 5 is a longitudinal section through an actuator provided with a displacement measuring unit for directly measuring the stroke of the pin.

FIGS. 3–5 show actuators according to the invention which can be built into a doctor blade device for controlling the thickness or cross section of the coating.

The coating system comprises a metering arrangement for applying the coating material to the web and a scraper blade 27 or the like extending across the width of the web and elastically deformable by a flexible bar 29. The foot of the blade can be replaceably clamped in the scraper beam 28. The blade 27 is engaged by the bar 29, which extends the full width of the web, along the rear side of the bar below its tip. At spaced apart locations, setting elements engage the bar 29, preferably with the spacing of 50 mm to 150 mm over the entire width. The setting elements generate a pressing force which urges the blade 27 against the coated web so that differences in local thicknesses of the coating can be levelled out.

In direct coating, the blade scrapes excess material from the coating directly on the web whereas for indirect coating the blade scrapes excess coating material from the film on a transfer roller, the transfer roller applying the film to the paper or cardboard web. A metering system of this type is shown, for example, in WO 93/17795.

According to the invention, the setting elements are affixed on the upper side of the beam 28 with their housing parts 18. In that case, the force-generating part, as has been described previously, can be simply removed. The setting pins which are threaded into the back of the member 29 form both holders for the member 29 and adjustment devices therefor. An axial shift on each setting pin 8 allows the bar 29 to be adjusted differently at each location so that a corresponding series of pressing forces can be applied to the doctor blade 27 and the transverse profile of the coating can be corrected.

In the embodiment of FIG. 3, on the cover plate 1 a measuring device 30 is mounted which, through an opening 30*a* in the cover plate 1, enables measurement of the transverse displacement x of spring plate 4 and thus an indirect measurement of the axial stroke s of the pin 8. The measuring device 30 can be a contactless proximity sensor.

In FIG. 5 I have shown an embodiment in which the stroke s of the pin 8 is directly measured. In this case the measuring device 31 is mounted on the cover plate 1 and responds to a displacement of the pin 14 (see FIG. 2) in the direction of the arrow s. The measuring device 31 can have a measuring rod 32 forming a sensor which is axially displaceable parallel to the pin 8 and which is biased by a spring 33 against the pin 14. The movement of the pin 8 is thus transmitted to the measuring device 31 and registered capacitatively or inductively.

Figure 6:
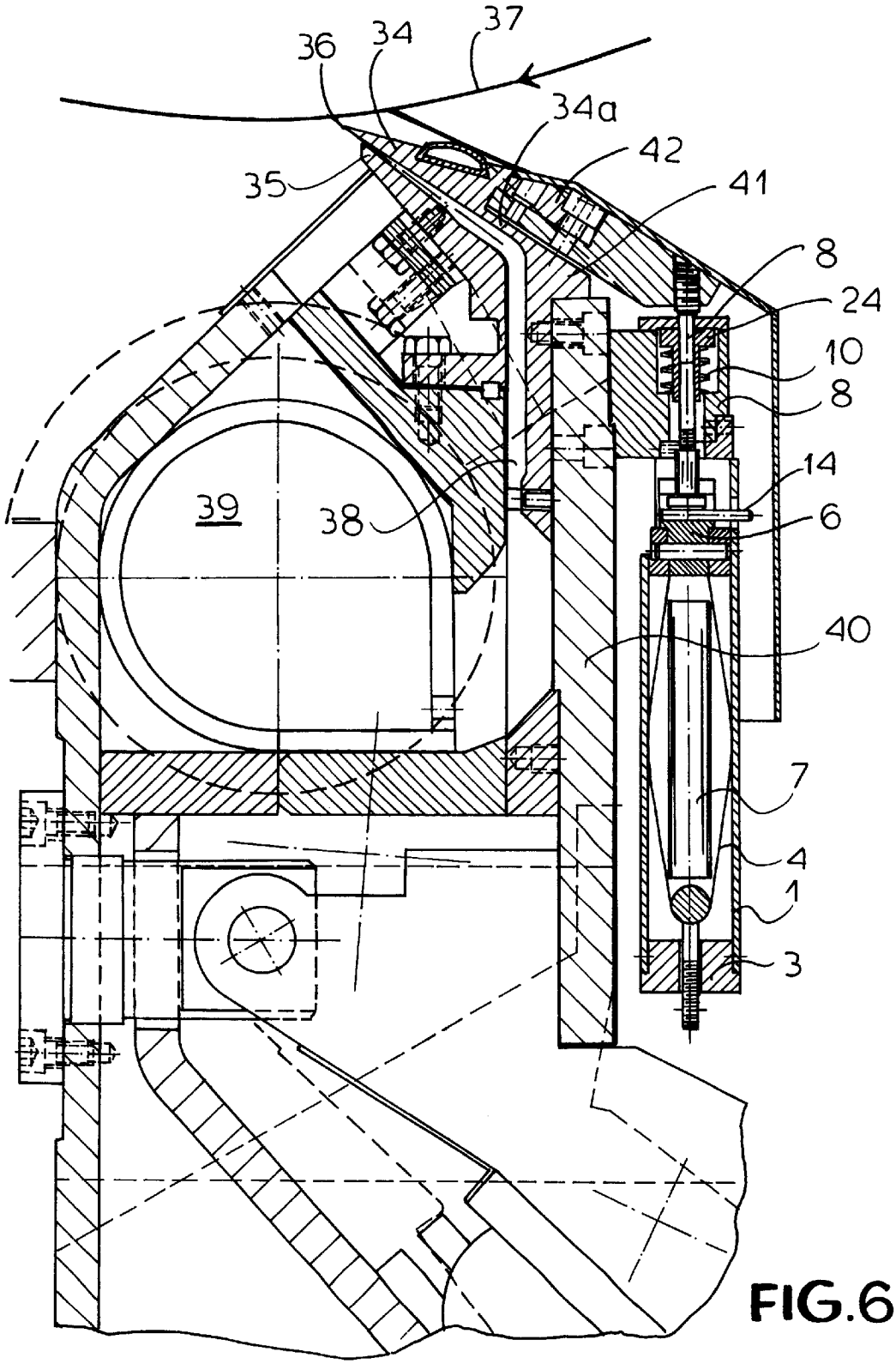
FIG. 6 is a longitudinal section,through an actuator and a transverse section through a free jet nozzle providing this actuator in a coating apparatus in which the actuator serves for the zonewise deflection of a bendable lip.

FIG. 6 shows the use of the actuators for controlling a free jet nozzle configuration. In this case, the coating device comprises a free jet nozzle formed between the two lips 34, 35 extending over the working width of the web. From the slit nozzle, the material to be coated onto the paper or cardboard web 37 is guided on a drum and can be projected in a jet 36 onto that web. The nozzle 34, 35 is connected with a supply passage 38 to which the coating material is fed from the die chamber 39. The nozzle lip 34 is affixed to an endless side wall 40 of the device via an angled member 41 with respect to which the lip 34 is limitedly bendable, enabling the spacing of the lip 34 from the lip 35 to be varied zonewise across the width of the web.

Adjustment of the spacing of the lips 34 and 35 from one another is effected by means of actuators according to the invention, uniformly spaced across the width of the web, for example at every 100 mm and mounted with their housing portions 18 on the wall 40. The lip 34 can be extended into a tongue 42 forming a lever arm 43 for each actuator. At the free end of each lever arm 43, the pin 8 of the respective actuator is screwed. By varying the stroke of the pins 8, each lever 43 can be tilted up or down about the fulcrum formed by the slender portion 34*a* of the lip to enable the respective zone of the lip to be bent toward or away from the fixed lip 35 varying the cross section of the nozzle slit.

I claim:

1. A pneumatically operated actuator comprising:

a frame;

a pair of generally parallel, mutually spaced apart sheet-metal spring plates in said frame and secured to said frame at one side of said plates;

a pin longitudinally shiftable in said frame and secured to an opposite side of said pair of plates;

a pneumatic cushion formed between said plates and connectable to a source of compressed air whereby pressurization of said cushion deflects said plates transversely, thereby longitudinally shifting said pin; and a spring on said frame yieldably counteracting transverse deflection of said plates.

2. The pneumatically operated actuator defined in claim 1 wherein said pin is guided through a seat for said spring, said spring being a compression spring braced between said seat and biasing said pin axially outwardly of said frame.

3. An apparatus for coating a web comprising:

a plurality of coating control elements disposed across a path of a web to be coated and respectively positionable to vary a basis weight of a coating applied to said web; and a respective pneumatically operated actuator for each of said elements, each of said actuators comprising:

a frame, a pair of generally parallel, mutually spaced apart sheet-metal spring plates in said frame and secured to said frame at one side of said plates, a pin longitudinally shiftable in said frame and secured to an opposite side of said pair of plates, a pneumatic cushion formed between said plates and connectable to a source of compressed air whereby pressurization of said cushion deflects said plates transversely, thereby longitudinally shifting said pin, and a spring on said frame yieldably counteracting transverse deflection of said plates.

4. The apparatus defined in claim 3 wherein said elements act upon a bendable member extending across at least a portion of the width of said web and acting upon a blade shaving excess coating material from said coating.

5. The apparatus defined in claim 3 wherein said elements act upon a bendable nozzle lip of a slit nozzle for dispensing said coating in a free jet onto a surface.

6. A pneumatically operated actuator comprising:

a frame;

a pair of generally parallel, mutually spaced apart sheet-metal spring plates in said frame and secured to said frame at one side of said plates;

a pin longitudinally shiftable in said frame and secured to an opposite side of said pair of plates;

a pneumatic cushion formed between said plates and connectable to a source of compressed air whereby pressurization of said cushion deflects said plates transversely, thereby longitudinally shifting said pin;

a spring on said frame yieldably counteracting transverse deflection of said plates; and a foil between said pneumatic cushion and said plates.

7. A pneumatically operated actuator comprising:

a frame;

a pair of generally parallel, mutually spaced apart sheet-metal spring plates in said frame and secured to said frame at one side of said plates;

a pin longitudinally shiftable in said frame and secured to an opposite side of said pair of plates;

a pneumatic cushion formed between said plates and connectable to a source of compressed air whereby pressurization of said cushion deflects said plates transversely, thereby longitudinally shifting said pin;

a spring on said frame yieldably counteracting transverse deflection of said plates; and a displacement-measuring device for measuring an axial stroke of said pin.

8. A pneumatically operated actuator comprising:

a frame;

a pair of generally parallel, mutually spaced apart sheet-metal spring plates in said frame and secured to said frame at one side of said plates;

a pin longitudinally shiftable in said frame and secured to an opposite side of said pair of plates;

a pneumatic cushion formed between said plates and connectable to a source of compressed air whereby pressurization of said cushion deflects said plates transversely, thereby longitudinally shifting said pin;

a spring on said frame yieldably counteracting transverse deflection of said plates; and a measuring device for measuring deflection of one of said plates perpendicular to a direction of displacement of said pin.

* * * * *